US006067859A

United States Patent [19]

Käs et al.

[11] Patent Number: 6,067,859

[45] Date of Patent: May 30, 2000

[54] OPTICAL STRETCHER

[75] Inventors: Josef A. Käs; Jochen R. Guck, both of Austin, Tex.

[73] Assignee: The Board of Regents, The University of Texas System, Austin, Tex.

[21] Appl. No.: 09/262,231

[22] Filed: Mar. 4, 1999

[51] Int. Cl.[7] ..... G01L 1/24

[52] U.S. Cl. ..... 73/800; 250/251

[58] Field of Search ..... 73/800; 250/251

[56] References Cited

U.S. PATENT DOCUMENTS

| | | | |
|---|---|---|---|
| 5,367,160 | 11/1994 | Ishikawa et al. | 250/251 |
| 5,689,109 | 11/1997 | Schutze | 250/251 |
| 5,935,507 | 8/1999 | Morito et al. | 264/482 |

OTHER PUBLICATIONS

Discher, Mohandas, and Evans "Molecular Maps of Red Cell Deformation: Hidden Elasticity and in Situ Connectivity," Science, vol. 266 Nov. 1994 pp. 1032–1035.

Radmacher, Fritz, Kacher, Cleveland and Hansma "Measuring the Viscoelastic Properties of Human Platelets with the Atomic Force Microscope," Biophysical Journal, vol. 70, pp. 556–567 (Jan. 1996).

Elson, Elliott L., "Cellular Mechanics as an Indicator of Cytoskeletal Structure and Function," Biophys. Chemical vol. 17, pp. 397–430 (1998).

Eichinger, Köppel, et al. "Mechanical Perturbation Elicits a Phenotypic Difference Between Dictyostelium Wild–Type Cells and Cytoskeletal Mutants," Biophys. Journal, vol. 70, pp. 1054–1060 (Feb. 1996).

Askar'yan, G.A. and Lebedev, P.N., "Radiation Pressure on an Object with Varying Polarizability Changes. Deformation Absorption of a Wave by Variable Inhomogeneities," Pis. Red. 9, No. 7, pp. 242–243 (Apr. 1969).

Kats, A.V. and Kontorovich, V.M., "Bending of Surface and Self–Focusing of a Laser Beam in a Linear Medium," Pis. Red. 9, pp. 112–114, (Feb. 5, 1969).

Ashkin, A., "Acceleration and Trapping of Particles by Radiation Pressure," Physical Review Letters, vol. 24, No. 4., pp. 156–159 (Jan. 26, 1970).

Ashkin, A. and Dziedzic, J.M., "Radiation Pressure on a Free Liquid Surface," Physical letter Review, vol. 30, No. 4, pp. 139–1442 (Jan. 22, 1973).

Nichols, E.F. and Hull, G.F. "A Preliminary Communication on the Pressure of Heat and Light Radiation," Pressure of Radiation, vol. XIII, No.5, pp. 307–320.

Lebedew, P.N., "Untersuchungen über die Druckkräfte des Lichtes," Annalen der Physik, No. 11, pp. 433–458 (1901).

Chu, Stephen, "Laser Trapping of Neutral Particles Lasers can be used to trap and manipulate electrically neutral particles. These techniques have allowed scientists to cool vapors to near absolute zero, develop new atomic clocks and stretch single molecules of DNA," Science American, pp. 71–76 (Feb. 1992).

Phillips and Metcalf, "Cooling and Trapping Atoms, atoms are slowed and cooled by pressure from laser light and then trapped in a bottle whose "walls" are magnetic fields. Cooled atoms are ideal for exploring basic questions of physics."

(List continued on next page.)

*Primary Examiner*—Max Noori
*Attorney, Agent, or Firm*—O'Keefe, Egan & Peterman

[57] ABSTRACT

This invention concerns a novel optical micromanipulation tool, referred to as the optical stretcher, which may use a tunable laser to trap and deform cells between two counter-propogating beams generated by the laser. It is possible to detect the deformation of cancer cells.

20 Claims, 2 Drawing Sheets

OTHER PUBLICATIONS

Cohen–Tannoudji and Phillips, "New Mechanism for Laser Cooling, Optical pumping and light shifts have unexpectedly conspired to improve laser cooling by orders of magnitude and to produce the lowest kinetic temperature ever measured," Physics Today, pp. 33–40 (Oct. 1990).
Chu, Stephen, "Laser Manipulation of Atoms and Particles," Science, vol. 253, pp. 861–866 (Aug. 1991).
Ashkin, Dziedzic, and Yamane, Optical Trapping and Manipulation of Single Cells Using Infrared Laser Beams, Nature, vol. 330, pp. 769–771 (Dec. 1987).
Ashkin and Dziedic, "Optical Trapping and Manipulation of Viruses and Bacteria," Science, vol. 235, pp. 1517–1520 (Mar. 20, 1987).
Padgett, Miles & Allen, Les, "Optical Tweezers and Spanners, Laser Beams are now routinely used to trap, manipulate and move biological specimens, and the latest advances allow sampled to be rotated as well," Physics World, pp. 35–38 (Sep. 1997).
Ashkin, Dziedzic, Bjorkholm & Chu, "Observation of a single–beam Gradient Force Optical Trap for Dielectric Particles," Optics Letters, vol. 11, No.5., pp. 288–290 (May 1986).
Ashkin, A., "Forces of a Single–beam Gradient laser trap on a dielectric sphere in the ray optics regime," Biophys. Journal, vol. 61, pp. 569–582 (Feb. 1992).
Wight, W.H. and Sonek, G.J., "Radiation Trapping Forces on Microspheres with Optical Tweezers," American Institute of Physics, pp. 715–717 (Aug. 1993).
Gussgard, R., Lindmo, T., & Brevik, I., "Calculation of the Trapping Force in a Strongly Focused Laser Beam," J. Opt. Soc. Am., vol. 9, No. 10, pp. 1922–1930 (Oct. 1992).
Visscher, K. and Brakenhoff, G.J., "Theoretical Study of Optically Induces Forces on Spherical Particles in a single Beam Trap I: Rayleigh Scatterers," Optik, vol. 89, No. 4, pp. 174–180 (1992).
Roosen, G. and Imbert, C., "Optical Levitation by Means of Two Horizontal Laser Beams: A Theoretical and Experimental Study," Physics Letters, vol. 59A, No. 1, pp. 6–8 (Nov. 1976).
Roosen, G., "La lévitation optique de sphères," Can. J. Phys., vol. 57, pp. 1260–1279 (Apr. 1979).
Roosen, G. "A Theoretical and Experimental Study of the Stable Equilibrium Positions of Spheres Levitated by Two Laser Beams," Optics Comm., vol. 21, No. 1, pp. 189–194 (Apr. 1977).
Ashkin, A. and Dziedzic, J.M., "Optical Levitation by Radiation Pressure," Applied Physics Letter, vol. 19, No. 8, pp. 283–285 (Oct. 1971).
Ashkin, A., "The Pressure of Laser Light, the forces exerted by a focused beam of laser light are strong enough to push tiny particles around freely in various mediums. Several applications based on this recent finding are proposed," ??? pp. 63–71.
Ashkin and Dziedic, "Optical Levitation in High Vacuum," Applied Physics Letters, vol. 28, No. 6, pp. 333–335 (Mar. 1976).
Ashkin and Dziedic, "Observation of Light Scattering from Nonspherical Particles Using Optical Levitation," Applied Optics vol. 19, No. 5, pp. 660–668 (Mar. 1980).
Kuo and Sheetz, "Optical Tweezers in Cell Biology," Trends in Cell Biology, vol. 2, pp. 116–118 (Apr. 1992).
Berns, Wright and Steubing, "Laser Microbeam as a Tool in Cell Biology," Int'l. Review of Cytology, vol. 129, pp. 1–44 (1991).
Greulich and Webert, "Invited Review: The Light Microscope on its Way from an Analytical to a Preparative Tool," Journal of Microscopy, vol. 167, pp. 127–151 (Aug. 1992).
Weber and Greulich, "Manipulation of Cells, Organelles, and Genomes by Laser Microbeam and Optical Trap," Int'l. Review of Cytology, vol. 133, pp. 1–40 (1992).
Svoboda, and Block, "Biological Applications of Optical Forces," Biophys. Biomol, Struct. vol. 23, pp. 247–285 (1994).
Constable, Mervis, Zarinetchi & Prentiss, "Demonstration of a Fiber–Optical Light–Force Trap," Optics Letters, vol. 18, No. 21, pp. 1867–1869 (Nov. 1, 1993).
"Model AOM–802N Acousto–Optic Light Modulator S/N 404859 Instruction Manual," IntraAction Corp.
Strey, Helmut, "Bestimmung elastischer Eigenschaften von Zellmembranen und Zytoskelett mittels Flickerspektroskopie," Ph.D. Thesis 1993, TU München, Germany.
Zerman, Karin, "Untersuchung physikalisch and biochemisch induzierter Änderungen der Krümmungselastizität der Erythrozytenmembran mittels Fourierspektroskopie der thermisch angeregten Oberflächenwellen (Flickern)," TU München, Germany (1989).
Alberts, Bray, Lewis, Raff, Roberts & Watson, "The Specific Interactions of a Macromolecule Depend on Weak, Noncovalent Bonds," Molecular Biology of the Cell, Third Edition (1994).
Simmons, R.M. and Finer, J. T., "Optical Tweezers—Glasperlenspiel II" *Current Biology*, vol. 3, No. 5, pp. 309–311.
Block, Steven M., "15. Optical Tweezers: A New Tool for Biophysics" *Noninvasive Techniques in Cell Biology*: 375–502 (1990).
Ashkin, A. "Applications of Laser Radiation Presure," Science, vol. 210, No. 4474, pp. 1081–1088 (Dec. 1980).

OPTICAL STRETCHER

BACKGROUND OF INVENTION

The first direct experimental confirmation in a laboratory that light carries momentum was accomplished by E. F. Nichols and G. F. Hull in the U.S. (Nichols E. F., Hull G. F., Phys. Rev. 13, p.307 (1901)) and P. N. Lebedev in Russia (Lebedev P. N., Ann. Phys. (Leipzig) 6, p.433 (1901)) around the turn of the century. In both experiments the radiation pressure of a light source was detected by the twisting motion of mirrors suspended by thin wires in a high vacuum. The vacuum was crucial to eliminate the effects of thermal or radiometric forces. No one at the time imagined that there would be any practical application for this minute effect. The first process in which photon momentum played an important role was the Compton effect, i.e. the scattering of X-rays against electrons. Another four decades passed until the invention of the laser in 1960. The possibility of producing spatially coherent light with very high intensity brought the effect of radiation pressure into the macroscopic world. An early pioneer in this field was A. Ashkin at Bell Laboratories. Ashkin was the first to use a laser for manipulating transparent, micron sized latex spheres in the late 60s. These spheres, suspended in a water solution, were first accelerated with one horizontal laser beam and then trapped in between two beams in a second experiment (Ashkin A., "*Acceleration and Trapping of Particles by Radiation Pressure*" Phys. Rev. Lett. 24(4) p.156–159 (1970)).

Since then, this characteristic of light has been exploited in many ways. One broad field is the trapping and cooling of atoms and molecules. The fact that this year's Nobel prize was awarded to Steven Chu, William D. Phillips, and Claude Cohen-Tannoudji for the development of methods to cool and trap atoms with laser light shows its absolute relevance to today's science (Chu S., "*Laser Trapping of Neutral Particles*" Sci. Am., p.71 (February 1992); Phillips W. D., Metcalf H. J., "*Cooling and Trapping Atoms*" Sci. Am., p.36 (March 1987); Cohen-Tannoudji C., Phillips W. D., "*New Mechanisms for Laser Cooling*" Physics Today, p.33 (October 1990); Chu S., "*Laser Manipulation of Atoms and Particles*" Science 253, p.861–866 (1991)).

The interactions of light with dielectric matter can be divided into two predominant forcing mechanisms. The gradient force, which pulls material with a higher relative index towards the areas of highest intensity in a laser beam, and the scattering force, which is a result of the momentum transfer of photons to the material. Most optical micromanipulation tools rely on gradient forces. However, the "Optical Stretcher" of this invention uses the scattering forces to deform elastic dielectric samples.

The characteristics of these two forces (gradient and scattering force) allow for different possible trap designs.

One of the first stable traps was the levitation of particles with a vertical laser beam (Ashkin A., Dziedzic J. M., "*Optical Levitation by Radiation Pressure*" Appl. Phys. Lett. 19(6), p.283–285 (1971); Ashkin A., "*The Pressure of Laser Light*" Sci. Am. 226, p.63–71 (1972); Ashkin A., Dziedzic J. M., "*Optical Levitation in High Vacuum*" App. Phys. Lett. 28(6), p.333–335 (1976); Ashkin A., Dziedzic J. M., "*Observation of Light Scattering from Nonspherical Particles Using Optical Levitation*" Appl. Opt. 19(5), p.660–668 (1980)). The scattering force is strong enough to balance gravity while the gradient force keeps the particle on the optical axis.

A big improvement in this trap was the use of a highly focused laser beam, first realized by Ashkin in 1986 (Ashkin A., Dziedizic J. M., Bjorkholm J. E. , Chu S., "*Observation of a Single-Beam Force Optical Trap for Dielectric Particles*" Opt. Lett. 11(5), p.288–290 (1986)), because it is independent of gravity and one can orient the trap in any direction in space or even use it in micro-gravity (Gussgard R., Lindmo T., Brevik I., "*Calculation of the Trapping Force in a Strongly Focused Laser Beam*" J. Opt. Soc. Am. B 9(10), p.1922–1930 (1992)). The idea is that extreme focusing leads to a point in space (rather than an axis) with a very high intensity. Thus, the gradient force pulls a dielectric particle towards this point. The focusing has to be strong enough that the gradient force overcomes the scattering force, which is an unwanted effect in this case, because it pushes the particle away from the focus. This is usually realized by directing a laser beam through a microscope objective with high numerical aperture (NA). An experimental improvement can be achieved by using an objective with a central field stop producing a conical dark field. This enhances the relative contribution from high NA illumination and diminishes the influence of the scattering force. At the same time the particle is trapped near the focus and can be observed with the microscope. This one-beam setup, usually referred to as the Optical Tweezer, has been studied extensively (Ashkin A., Dziedizic J. M., Bjorkholm J. E. , Chu S., "*Observation of a Single-Beam Force Optical Trap for Dielectric Particles*" Opt. Lett. 11(5), p.288–290 (1986); Ashkin A., "*Forces of a Single-Beam Gradient Laser trap on a Dielectric Sphere in the Ray Optics Regime*" Biophys. J. 61, p.569–582 (1992); Wright W. H., Sonek G. J., Berns M. W., "*Radiation Trapping Forces on Microspheres with Optical Tweezers*" App. Phys. Lett. 63, p.715–717 (1993); Gussgard R., Lindmo T., Brevik I., "*Calculation of the Trapping Force in a Strongly Focused Laser Beam*" J. Opt. Soc. Am. B 9(10), p.1922–1930 (1992); Visscher K., Brakenhoff G. J., "*Theoretical Study of Optically Induced Forces on Spherical Particles in a Single Beam Trap I: Rayleigh Scatterers*" Optik 89(4), p.174–180 (1992); Kuo S. C., Sheetz M. P., "*Optical Tweezers in Cell Biology*" Trends in Cell Biology 2, p.116–118 (1992)) and is widely used in biological applications. The power of the laser used is in the range of a few mW up to 1.5 W for the trapping of glass or latex beads and the achieved trapping forces vary from Pico- to Nanonewton depending on the size and index of refraction. For detailed reviews see Kuo S. C., Sheetz M. P., "*Optical Tweezers in Cell Biology*" Trends in Cell Biology 2, p.116–118 (1992); Bems M. W., Wright W. H., Steubing R. W., "*Laser Microbeam as a Tool in Cell Biology*" Int. Rev. Cytol. 129, p.1–44 (1991); Block S. M., *Optical Tweezers: A new Tool for Biophysics, in Noninvasive Techniques in Cell Biology*, G. S. Foskett J. K., Editor. 1990, Wiley-Liss.: New York. p. 375–402; Greulich K. O., Weber G., "*The Laser Microscope on its Way from an Analytical to a Preparative Tool*" J. Microsc. 167, p.127–151 (1991); Simmens R. M., Finer J. T., "*Glasperlenspiel II: Optical Tweezers*" Curr. Biol. 3, p.309–311 (1993); and Weber G., Greulich K. O., "*Manipulation of Cells, Organelles, and Genome by Laser Microbeams and Optical Traps*" Int. Rev. Cytol. 133, p.1–41 (1992).

Although the Optical Tweezer is a very powerful tool, it also has its limitations. The working distance of high NA objectives is very short and does not allow for additional test equipment between objective and object. The trapping zone is rather small (on the order of the light wavelength). It has been shown that a good trapping efficiency can only be achieved for indices of refraction smaller than ≈1.7 because of the loss of axial stability (the scattering force becomes stronger than the backward gradient force) (Svoboda K., Block S. M., "*Biological Applications of Optical Forces*" Annu. Rev. Biophys. Struct. 23, p.147–285 (1994)). Furthermore, focusing the beam down to the theoretical limit of spot sizes (half the wavelength of the used light) leads to very high intensities that can endanger the integrity of biological objects. Most cells trapped with an optical tweezer do not survive powers greater than 20–250 mW because the extreme focusing leads to very high local intensities. This depends also on the specific cell type and the used wavelength, of course (Ashkin A., Dziedzic J. M., Yamane T., "*Optical Trapping and Manipulation of Single Cells Using Infrared Laser Beams*" Nature 330(24), p.769–771 (1987); Ashkin A., Dziedzic J. M., "*Optical Trapping and Manipulation of Viruses and Bacteria*" Science 235, p.1517–1520 (1987); Kuo S. C., Sheetz M. P., "*Optical Tweezers in Cell Biology*" Trends in Cell Biology 2, p.116–118 (1992)).

A different setup, that circumvents most of these problems, is a two beam trap (Ashkin A., "*Acceleration and Trapping of Particles by Radiation Pressure*" Phys. Rev. Lett. 24(4) p.156–159 (1970); Roosen G., Imbert C., "*Optical Levitation by Means of Two Horizontal Laser Beams. A Theoretical and Experimental Study*" Phys. Lett. 59A(1), p.6–9 (1976); Roosen G., "*La Lévitation Optique de Sphères*" Can. J. Phys. 57, p.1260–1279 (1979); Ashkin A., Dziedzic J. M., "*Optical Levitation by Radiation Pressure*" Appl. Phys. Lett. 19(6), p.283–285 (1971)). Historically the two beam trap was developed more than a decade before optical tweezers but has since fallen into disuse. Two identical, counterpropagating laser beams with Gaussian beam profiles can stabilize a particle in the point of symmetry. The forces on a sphere are the superposition of the forces of two individual beams. The gradient force confines the particle to the axis while the scattering force provides stability along the axis. This is a stable configuration as long as the refractive index n of the particle is higher than that of the surrounding medium. Air bubbles in water, an example where this condition is not fulfilled, are pushed out of the beam (like a rubber ball out of a water beam). Another condition, which is somewhat unexpected, is that the diameter of the particle has to be smaller than the beam radii in the center. For the situation where the beam radius is smaller than the particle radius, and thus the ratio is larger than 1, the force closer to the waist of the beam is smaller than further away due to the divergence of the beam. This leads to an amplification of small displacements of the sphere from the center which means that the particle is not stably trapped (Roosen G., "*A Theoretical and Experimental Study of the Stable Equilibrium Positions of Spheres Levitated by Two Horizontal Laser Beams*" Opt. Comm. 21(1), p.189–195 (1977)).

An improvement of this setup has been demonstrated in which single mode (SM) optical fibers are used to deliver the laser beams to the trapping area (Constable A., Kim J., Mervis J., Zarinetchi F., Prentiss M., "*Demonstration of a Fiber-Optical Light-Force Trap*" Opt. Lett. 18(21), p.1867–1869 (1993)). This avoids the need for additional optical elements and their alignment, and allows a very easy and cheap implementation of the trap into custom made experiments. This trap can also be set up independently from a microscope. A good review of all these traps and their applications in biology can be found in Svoboda K., Block S. M., "*Biological Applications of Optical Forces*" Annu. Rev. Biophys. Struct. 23, p.147–285 (1994).

A new member in the family of light traps is the Optical Spanner (Padget M., Allen L., "*Optical Tweezers and Spanners*" Physics World, p.35–38 (September 1997)). The basic setup is as for the Optical Tweezer but instead of a Hermite-Gaussian laser profile, a Laguerre-Gaussian profile is used. These beams have a circular cross-section, a helical wavefront, and a Poynting vector that spirals around the axis. This means that such a beam has an orbital momentum in addition to the translational momentum previously discussed. Since the angular momentum of the system has to be conserved too, the particle starts to rotate. In this way particles can not only be translated but also rotated.

Although these traps are extremely useful for all kinds of manipulation of objects, they can only translocate and/or rotate them and are not intended to deform them. The Optical Stretcher of this invention expands the line of optical tools and allows for a fill spectrum of particle manipulation.

All existing methods to examine the elasticity of cells have their limitations. In micropipette aspiration experiments the tip of a micropipette is placed onto a cell with a micro-manipulator and part of the cell is pulled into the pipette with an applied negative pressure. This provides only very local information and can detach the membrane from the cell which leads to inaccurate measurements.

Another possibility is the use of an Atomic Force Microscope (AFM) in tapping mode (Radmacher M., Fritz M., Kacher C. M., Cleveland J. P., Hansma P. K., "*Measuring the Viscoelastic Properties of Human Platelets with the Atomic Force Microscope*" Biophys. J. 70, p.556–567 (1996)). The oscillating AFM tip is scanned across the cell body allowing the force and the indentation to be measured. Usually, the Young modulus of the cell is then determined using the Hertz model which assumes a semi-infinite slab of material and connects deformations to its material constants. The problem here is that the spring constant of the AFM tip/cantilever is rather big compared to the strength of the cytoskeleton which means that it is not possible to detect small elasticity differences of cells—the cell is either compressed or not. This treatment is also very rough, as many cells do not survive it. AFM also looks at the elasticity only over small areas of a cell's surface. Similar to this are "cell poking" experiments where the AFM tip is replaced by a glass needle (Elson E. L., "*Cellular Mechanics as an Indicator of Cytoskeletal Structure and Function*" Annu. Rev. Biophys. Chem. 17, p.397–430 (1988)).

Another major disadvantage, which all these methods have in common, is that they are not efficient. It is very inconvenient to position the micropipette or the AFM tip manually on a cell. Thus, it is effectively not possible to measure a significant number of cells in a short period of time which results in lack of good statistics.

A more indirect approach was to shear a whole pallet of densely packed cells with a rheometer (Eichinger L., Koppel B., Noegel A. A., Schleicher M., Schliwa M., Weijer K., Wittke W., Janmey P. A., "*Mechanical Perturbation Elicits a Phenotypic Difference Between Dictyostelium Wild-type Cells and Cytoskeletal Mutants*" Biophys. J. 70, p.1054–1060 (1996)). However, this is a bulk measurement and yields only mean values and not specific information about a single cell. Another limitation is that not only the cell elasticity but also sticking forces and friction between the cells influence the outcome of the measurement.

SUMMARY OF INVENTION

The present invention provides a solution to one or more of the disadvantages and deficiencies described above.

There exist several optical tools for the manipulation of dielectric particles such as biological cells. Until now, manipulation by radiation pressure was considered to be translation and rotation. This is the first time that the forces arising from the interaction of light with matter are used intentionally to deform cells in a controlled and nondestructive manner. With this novel tool, the "Optical Stretcher", it is possible to measure the elasticity of deformable objects, such as cells, with diameters typically between 5–50 microns. As used herein, "Optical Stretcher" refers to the invention described herein. Cells owe their stability to a three-dimensional network of filamentous polymers, known as the cytoskeleton. It is not understood how the cytoskeleton is able to provide a mechanical stability to cells, as classical concepts in soft condensed matter physics fail to explain this phenomenon. The use of the Optical Stretcher, in combination with modem techniques in molecular biology, will clarify the role of the cytoskeletal constituents. This novel symbiosis of physics and molecular biology will help to gain a clearer picture of the way the cytoskeleton works.

Furthermore, the Optical Stretcher may be used for the analytical detection of single malignant cells. Cancer cells are shown to modify their morphology compared to normal cells which changes their elasticity. This novel tool, the Optical Stretcher, will be useful in detecting these changes.

The Optical Stretcher is a novel technique to measure the elasticity of single cells which avoids the disadvantages mentioned above. The principle idea is to use two counterpropagating laser beams to trap a single cell, which is suspended in a buffer solution, by radiation pressure. The feasibility of the trapping itself was already demonstrated by A. Ashkin in the late 1960s. Since then, the trapping of all kinds of particles with sizes ranging from Angstroms (such as atoms and molecules) to tens of microns (such as small glass beads or cells) has found many applications.

This is the first time that this setup is used not only for trapping, moving, and rotating particles, but for the deformation of the particle under investigation in a noninvasive, nondestructive, and controlled way. The idea of deforming dielectric surfaces with intense light is not new. The effect was predicted by Askar'yan, Kats and Kantorovich (Askar'yan G. A., "*Radiation Pressure on an Object with Varying Polarizability Changes. Deformation Absorption of a Wave by Variable Inhomogenities*" JETP Lett. 9, p.241–243 (1969); Kats A. V., Kantorovic V. M., "*Bending of Surface and Self-Focusing of a Laser Beam in a Linear Medium*" JETP Lett. 9, p.112–114 (1969)) and later shown experimentally for a free liquid surface by Ashkin (Ashkin A., Dziedzic J. M., "*Radiation Pressure on a Free Liquid Surface*" Phys. Rev. Lett., 30(4) p.139–142 (1973)). Yet, no one realized the full potential of this effect and it has consequently been ignored, until now.

With this novel approach we can measure the elasticity of cells and circumvent most of the problems mentioned above. Even though it is a relatively simple setup, this invention may: investigate single cells without killing them, apply forces over a wide range, and take time dependent measurements over a broad frequency range (from mHz to MHz in principle) just by varying the light intensity. In addition, it is also possible to measure large numbers of cells in a short period of time by incorporating a flow chamber.

Diseases which effect the cytoskeleton, such as the malignant transformation of cells, can be analytically detected with the Optical Stretcher in a simple, inexpensive, and noninvasive way. Thus, it will be superior to existing techniques and a basis for successfully fighting these diseases.

In view of the foregoing, in one broad respect this invention is an apparatus, comprising: a stage capable of supporting micron-sized dielectric particles; two or more sources of laser light directed toward an area of the stage where the particles are located; a first detector which determines whether a particle is trapped between the first and second laser sources; a second detector which determines and/or measures deformation of a particle upon increasing intensity of the laser light; wherein the first and second laser sources may be adjusted to vary the power of the laser light to thereby either trap a particle or stretch the particle.

The dielectric particles to be used in the practice of this invention may vary widely from inanimate particles such as polymer beads such as latex or polystyrene beads to biological cells such as red blood cells and nerve cells.

In another broad respect, this invention is an apparatus comprising a stage capable of supporting biological cells in an aqueous medium, first and second sources of laser light directed toward an area of the stage where the cells are located, a first detector which determines whether a cell is trapped between the first and second laser sources, and a second detector which determines and/or measures deformation of a cell upon increasing intensity of the laser light whereas the first and second laser sources may be adjusted to vary the power of the laser light to thereby either trap a cell or stretch the cell.

In another broad respect, this invention is a process for the controlled deformation of biological cells. This process may be comprised of exposing a cell to two counterpropogating laser beams at an intensity sufficient to deform the cell, and optionally measuring the deformation of the cell.

In yet another broad respect, this invention is a process for the detection of individual cancer cells by measuring their deformability using the apparatus described above.

In still another broad respect, this invention is a process for the controlled deformation of micron-sized dielectric particles, comprising: exposing a particle to two or more counterpropogating laser beams at an intensity and under conditions effective to deform the particle; and optionally measuring the deformation of the particle.

In still another broad respect, this invention is a process for the controlled deformation of dielectric micron-sized particles comprising exposing a particle to several laser beams at an intensity sufficient to deform the particle and optionally measuring the deformation of the cell.

It is generally believed that the forces to deform mammalian cells cannot be achieved with laser without causing simultaneous radiation damage by heating, previous experiments used focused beams and the higher local laser intensities destroyed the cells. We have now recognized that this can be overcome by using optical fiber traps which have been previously used by to trap glass beads but not to stretch cells. Also, it has been predicted that laser light can deform dielectric surfaces. However, that the radiation pressure of two opposing laser beams stretches a cell is somewhat counterintuitive. One would expect that the cell would be squeezed. It is totally unexpected and surprising that two opposing laser beams do not squeeze a cell, that radiation pressure stretches cells. This is counterintuitive and not predicted in literature. While not wishing to be bound by theory, we can now explain this effect by the increase of momentum of the laser beam when it enters the cell. Due to momentum conservation this increase has to be compensated by a pulling force.

DETAILED DESCRIPTION OF THE INVENTION

The Optical Stretcher is a novel optical tool which uses one or more laser beams to pull on transparent, dielectric materials. In particular, a set up with two or more counter propagating beams can be used to stably trap and stretch micron-sized dielectric particles such as biological cells. The fact that the photon pressure of a laser beam entering or leaving a medium of higher refractive index pulls on the interface is unexpected, but can be explained by momentum conservation.

The type of cells that may be trapped and stretched may vary widely. For instance, this invention may be used to trap and deform eukaryotic cells including mammalian cells, except for muscle and neuronal cells which are too big for the stage shown herein. A representative, non-limiting list of such cells for use in the practice of this invention include epithelial cells, lymphocytes, macrophages, fibroblasts, PC12 cells, keratinocytes and melanoma cells. It may also be possible to use small tissue clusters with a diameter of about 100 microns.

Figure 1:
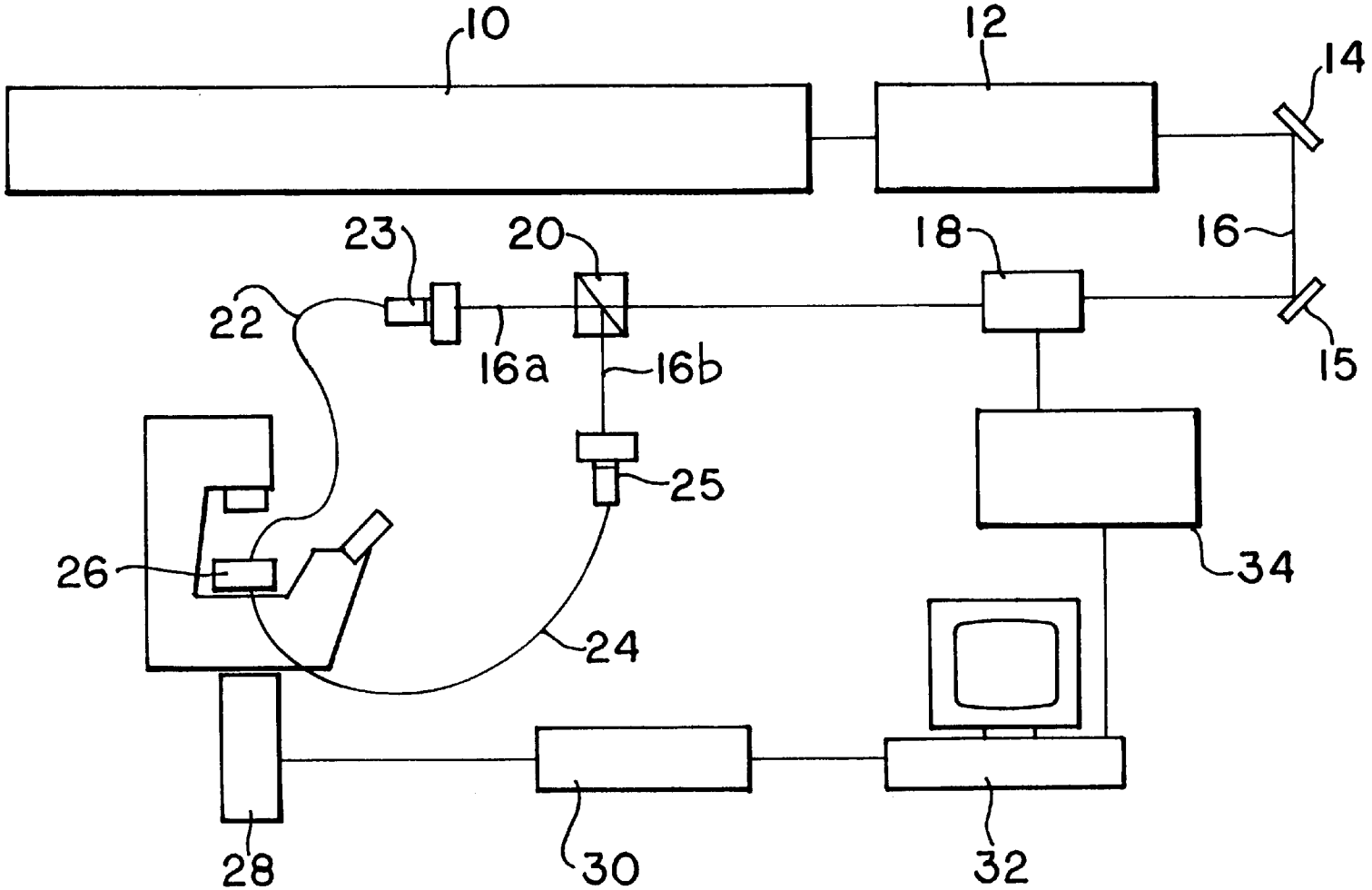
FIG. 1 shows a non-limiting, representative configuration for the apparatus of the invention.

FIG. 1 shows a setup for our experiment following the one of the two-beam fiber trap described in Constable A., Kim J., Mervis J., Zarinetchi F., Prentiss M., "*Demonstration of a Fiber-Optical Light-Force Trap*" Opt. Lett. 18(21), p.1867–1869 (1993). This set up is representative and should not be construed as limiting the scope of this invention.

Figure 2A:
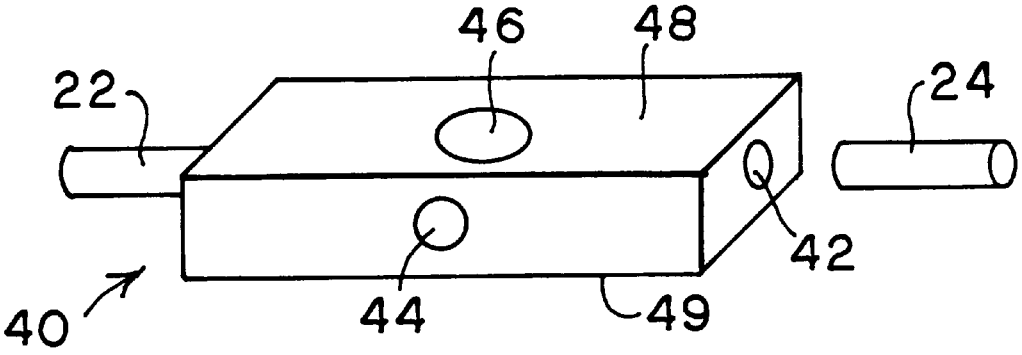
FIGS. 2A–2C show a non-limiting, representative perspective, top and side views of a stage that may be used in the practice of this invention.
Figure 2B:
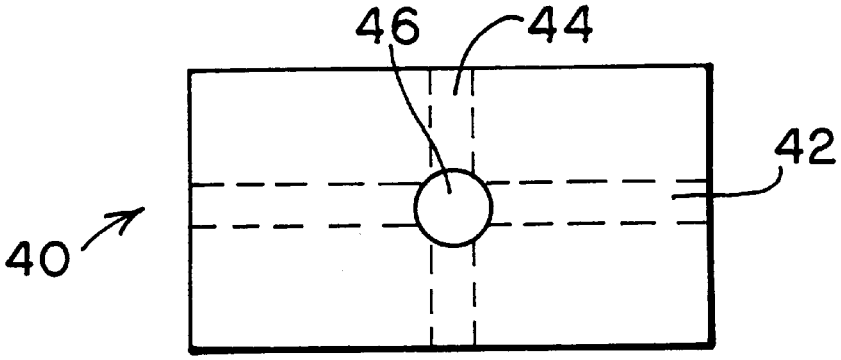
Figure 2C:
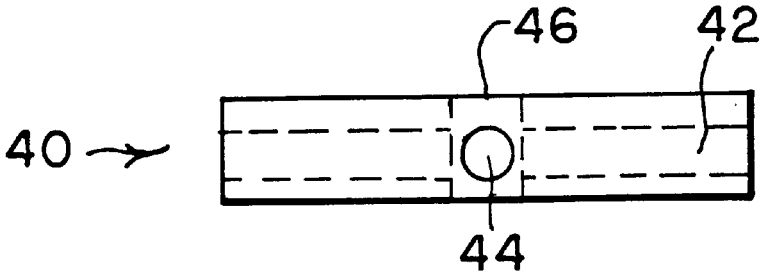

In FIG. 1 a first laser 10 such as an $Ar^+$-Laser (Spectra Physics Lasers, Inc., Beamlok 2080 RS), with up to 28 W power to pump, pumps a laser 12 such as a tunable, cw Ti-Sapphire Laser (Spectra Physics Lasers, Inc., 3900S having a wavelength of about 790 nanometers). While other wavelengths may be employed, we have found that for the stretching of live biological cells, a wavelength of from about 700 nanometers to about 900 nanometers, preferably from about 940 nanometers to about 840 nanometers. Two mirrors 14, 15 (Newport Corp.) are used for the height adjustment of the laser beam 16. The beam 16 is modulated a modulator 18 such as by an Acousto Optic Modulator (AOM) (IntraAction, AOM-802N), split in two 16*a*, 16*b* by a beam-splitter 20 (Newport Corp.) and then coupled into optical fibers 22, 24. The modulator 18 serves to regulate the laser power, and may be controlled by the computer 32 through the modulator driver 24. The fiber couplers 23, 25 were purchased from Oz Optics Ltd., the single-mode and multi-mode optical fibers from Newport. The optical fibers were connected to a stage (a flow chamber) 20. The flow chamber serves as a stage for the trapping and deformation of cells, and from which said trapping and detection may be detected (observed manually, electronically, automatically or otherwise). In the flow chamber 26 the beams 16*a*, 16*b* were directed at a sample guided by optical fibers 22, 24. The fibers are arranged so that counterpropogating beams are directed at one another. That is, the beams are precisely directed at each other. This enables trapping and deformation of a cell to occur. It is believed that the gradient provided by the beams brings about the stretching of the cell as the gradient forces pull the dielectric materials that make up the cell to the point of highest intensity. Prior attempts to use light to deform (stretch) the cell led to destruction of the cell because the intensity of the beam was too strong. In prior methods, for instance, optics were used to focus (intensify) the beam to restrict the divergence of the beam after leaving the laser. In the present invention, by contrast, the gradient forces are minimal. The higher refractive index of the cell leads to a change in momentum that leads to scattering forces. The increased momentum of the beam in the cell is compensated for by the cells stretching in the direction of the beam. An alternative to the flow chamber in FIGS. 1 and 2A–2C a, a third channel in the z-direction may be bored of elliptical profile. The channels for the fibers, flow of cells and elliptical profile cross paths as depicted by dotted lines in FIGS. 2B and 2C. If a cell blocks the elliptical channel, conductance along this channel will go down. If the cell is stretched in the parallel direction of the long axis of the ellipse, the blocking will increase and the conductance will go further down, being a measure of the degree of stretching if conductance is used to detect trapping and deformation of the cell. It should be appreciated that the cells that move through the stage may be counted using an automated cell counter such as sold currently by Coulter. Returning to FIGS. 2A–2C, the flow chamber 40 for use in the configuration of FIG. 1 may have the size of an optical microscopy slide, but the dimensions may vary widely. The stage may include one or more microscope slides that are secured to the top 48 and/or bottom 49 of the stage 40. In one embodiment, the flow chamber 40 is bored to provide channels 42 in which the optical fibers 22, 24 are inserted. The channels 42, shown in FIGS. 2B and 2C by dotted line, thus serve to guide the fibers. Another channel 44, generally perpendicular to the guidance channels 42, serves to form a conduit through which the stream of cells are flowed. The cell 44 and guidance 42 channels may be considered to be formed in the xy-plane. A third bore 46 may also be made in the z-plane, which bisects the intersection of the cell 44 and guidance 42 channels. The bore 46 serves to form an aperture for illumination for phase contrast microscopy. Alternatively, the third bore 46 may be of elliptical dimension, with electrodes being suitably attached for conductance measurement.

All optics mounts were either made by the Physics Department machine shop or by the inventors in a machine shop for the University of Texas. The Optical Stretcher itself was set up on an inverted microscope (Zeiss Axiovert TV100) equipped for phase contrast and fluorescence microscopy. We used an Olympus 20X objective to control the overall setup. The microscope serves to both detect the trapping and stretching of the cell. While a microscope is shown in FIG. 1, other devices, such as devices that measure conductance, may be used. The low magnification of this objective is ideal for checking the alignment of the fibers and to trap cells. For the observation of the small deformations of the cells we used a Zeiss LD Achroplan (40X, NA 0.60) with different additional magnification lenses. Cells in general are very transparent and their visibility in a normal through-light microscope is limited. There are several microscopy techniques which exploit different other optical properties of cells besides their absorption such as the phase change of light when it passes through them. Phase-contrast microscopy is one of them and the one we used in the experiments unless otherwise stated. An additional benefit of phase-contrast microscopy is that sizes of objects can be determined with an accuracy of tens of nanometers—much less than the optical resolution in light microscopy. In phase contrast microscopy objects seem to have a bright halo around them. The jump in contrast is therefore very steep and can easily be detected with the well known, appropriate image processing software. This fact was used to determine the deformations of the cells. Images were obtained with a CCD camera (MTI-Dage CCD72S), connected to the microscope by a 4X coupler, and recorded on a SVHS recorder 30 (Panasonic DS550). The camera is optionally used. The output from the camera is digitized and analyzed by the computer for the degree of stretching. In the system shown in FIG. 1, the microscope may operate in the phase contrast mode, with objectives of 20X and 40x magnification being used in one embodiment of this invention. These images were then evaluated on a PowerComputing computer (PowerTower Pro 225) with NIH-Scion Image software (V 1.60). The pixel size for all used magnifications was calibrated with a 100 lines/mm grating which allowed for absolute distance measurements.

OPTICAL COMPONENTS

One important component of the configuration of FIG. 1 is the acousto-optic modulator (AOM). The main part of an AOM is a crystal with appropriate transmittance (in our case, dense flint glass for high transmittance in the range from 700–1300 nm). When a RF frequency signal is applied to this crystal through an piezoelectric transducer, a sound wave (wavelength $\Lambda$) travels through it and creates a standing wave. This standing wave produces a density grating in the crystal. The frequency $f$ of the RF signal is chosen in a way that the wavelength of the grating is on the order of the optical wavelength of the light $\lambda$. An AOM can be used for deflection, intensity control, and optical frequency shifting of a laser beam, as well as multiple beam generation.

If a laser beam enters the crystal under a certain angle so that the Bragg condition is fulfilled, the beam is deflected by multiples of twice the Bragg angle $\theta_B$, $$\theta_{defl} = 2 \cdot n \cdot \theta_B = \frac{n \cdot \lambda}{\Lambda} \tag{20}$$

Usually the 0th order beam is blocked and the first order beam is used. The percentage of light $I_1$ in the first order, also called diffraction efficiency $\eta$, is given by, $$\eta = \frac{I_1}{I} = \sin^2\left(2.22 \cdot A \frac{\sqrt{P_a}}{\lambda}\right) \tag{21}$$

where $P_a$ is the acoustic power and A is a material constant. By changing the power of the RF signal the diffraction efficiency can be changed from 0–80%. In this way the AOM can be used for modulating the intensity of a transmitted laser beam.

Another important component of this setup is the optical fiber. By coupling the laser beam into a fiber it is possible to deliver the light very easily to any desired place. This allows us to have the laser and all required optics on one table and the microscope at any other convenient location.

One distinguishes between single mode (SM) and multimode (MM) fibers. From electrodynamics it is known that the solutions for the transverse electromagnetic fields in a waveguide have certain shapes which are called modes and denoted by $TEM_{xy}$ (x and y usually stand for the number of radial and azimuthal nodes in cylinder coordinates). For example, the $TEM_{00}$ has an exact Gaussian profile. A MM fiber transmits many different modes whereas a SM fiber only transmits the $TEM_{00}$ mode and suppresses all other modes. For all optical traps as described above, it is crucial to have a Gaussian profile of the laser beam so that there is a gradient in intensity towards the beam axis. Thus, a SM fiber is usually the best choice (Constable A., Kim J., Mervis J., Zarinetchi F., Prentiss M., "*Demonstration of a Fiber-Optical Light-Force Trap*" Opt. Lett. 18(21), p.1867–1869 (1993)). Also, if the mode quality of the laser beam is not very good, the SM fiber serves as spatial filter and guarantees a clean Gaussian profile. One disadvantage of a SM fiber is that it is harder to couple the beam into the fiber (the possible coupling efficiency is only about half of that of MM fibers), and it is not possible to transmit as high light powers. The highest transmitted powers in this invention with the SM fiber have thus far been about 200 mW for an input power of 2.5 W. With the MM fiber the invention may able to transmit more than 500 mW. Another difference is that these fibers are especially designed for a certain wavelength band. For SM fibers the mode-field-diameter, which is the diameter of the part of the fiber actually carrying light is directly related to the wavelength band: the shorter the wavelength the smaller the mode-field-diameter. This means that one is restricted to a certain beam size once a certain operating wavelength is chosen. For MM fibers there is no fixed relation between wavelength and mode-field-diameter so that this is an additional parameter which can be varied.

The fibers are also the most fragile technical component of the setup. In one embodiment, the diameter of the stripped fiber is only 125 micron and breaks very easily. The optical performance of the fiber depends strongly on the quality of the ends. They have to be very flat and ideally perpendicular to the axis. At present, we have used a very simple fiber cleaver (Siecor Corp., FBC 001), which gave satisfying results, although it usually took several attempts.

The alignment of the fibers is very crucial. If they are not coaxially aligned, a misalignment on the order of 1 micron is enough, the cell cannot be trapped stably. The solution described in Constable A., Kim J., Mervis J., Zarinetchi F., Prentiss M., "*Demonstration of a Fiber-Optical Light-Force Trap*" Opt. Lett. 18(21), p.1867–1869 (1993) may be used to achieve the required accuracy: Glass pipettes were heated up and then pulled out to diameters of 250–400 $\mu$m. This small capillary was glued down on a coverslide and the fibers were pressed against it. Sitting in this V-groove they were facing each other with the appropriate accuracy. We filled the capillaries with black ink to reduce the light which was scattered from them. This increased the visibility of the cells and their deformation.

This setup is only a transient solution and was used because it is very simple and allows for quick changes. The disadvantages are that only small sample sizes can be handled, the trapping of cells requires the manual positioning of the fiber along the capillary by means of micrometer-translation stages, and the experiment cannot be controlled very well. The trapping would be easier with a very high cell density in solution. However, this also increases the danger that several cells are trapped at the same time. Use of closed flow chamber may solve these problems.

WAVELENGTH CONSIDERATIONS

An important aspect in the trapping of living cells is the choice of the right wavelength light to be used. It is important that the cell survives the laser irradiation and the deformation since only a vital cell will show the characteristics we want to investigate. Clearly, a dead cell is not able to maintain a representative cytoskeleton.

When Ashkin started his experiments, he used the 530 nm line of an $Ar^+$-Laser because it was the most convenient and stable laser at this time. For the trapping of inanimate matter, such as glass or silica beads, the wavelength is not very important. A short wavelength might be desirable because the photons have a higher energy and, since the spot size of a focused beam is on the order of half the wavelength, it allows for higher gradients and better trapping efficiencies. Also the criterion for the ray optics regime is easier to fulfill and the calculation of the forces on smaller particles becomes easier.

When Ashkin used these light traps for the manipulation of cells, however, he immediately found out that the wavelength was not appropriate to preserve these objects. He created the term "opticution" for the killing of cells due to light absorption. He resorted to the 1064 nm of a Nd-YAG laser and achieved better results (Ashkin A., Dziedzic J. M., Yamane T., "*Optical Trapping and Manipulation of Single Cells Using Infrared Laser Beams*" Nature 330(24), p.769–771 (1987)). Most tweezers are still equipped with a Nd-YAG laser. However, this is not optimal either. The absorption of chromophores, which is the term for predominantly absorbing components in a cell, is low in the IR and increases with decreasing wavelength. The absorption peaks of proteins, for example, lay in the UV region. This fact is utilized to measure their concentration in a solution by absorption spectrometry. The main content of an average cell, however, is water (~70% of the weight) which absorbs increasingly with larger wavelength. At around 800 nm the absorption of light and thus thermal problems should be minimized. For this reason, we use a Ti-Sapphire laser at its peak emission at about 790 nm. With the tunability from 600–1000 nm we can in principle cover the whole region of interest.

Even though we are far away from the absorption bands of proteins, nonlinear effects could come into play. Generally, nonlinear optical processes occur at very high light intensities where two (or more) photons with a certain energy can excite the same transitions as one photon with twice (or several times) this energy. Pulsed Ti-Sapphire lasers are used in two-photon spectroscopy to exactly excite these UV absorption bands of proteins. In the practice of this invention we are working with relatively high light powers. However, the intensities are still far away from the intensities encountered with pulsed lasers and the intensities needed for multi-photon excitation since a cw laser is used and the beam is not focused. Consequently, these nonlinear effects can be neglected and should not cause any problems. There is still the danger of inducing some kind of photochemistry. A possible scenario is that oxygen is broken into radicals which are extremely toxic for cell processes. These effects are not well understood at all.

SAMPLE PREPARATION

The first biological cells we examined were human erythrocytes, also called red blood cells (RBC). These cells were chosen for experimentation because they are easy to obtain and to handle. RBCs are responsible for transporting oxygen from the lung to all body parts. The oxygen is bound to hemoglobin which has a higher absorption coefficient than most other biological molecules. Hemoglobin is the main content of RBCs other than water. Since this invention seeks to minimize the thermal heating of cells, the highly absorbing RBCs are a good test. There are two other aspects of RBCs which are advantageous for studies. RBCs lack any organelles (nucleus, Golgi apparatus, mitochondria) which means that they come close to the ideal picture of an isotropic dielectric medium without internal structure. Furthermore, RBCs only have a thin layer of cytoskeleton right beneath their membrane and no three-dimensional network of polymers throughout the cell volume. Thus, they are much softer than real cells and it is easier to observe deformations of the cell shape. This made them a perfect choice as initial test objects.

All chemicals, unless otherwise stated, were purchased from Sigma. The buffer used for the RBCs was 100 mM NaCl, 20 mM Hepes buffer, 25 mM Glucose, 5 mM KCl, 3 mM $CaCl_2$, 2 mM $MgCl_2$, 0.1 mM Adenine, 0.1 mM Inosine, 1% (volume) Antibiotic-Antimycotic solution, 0.25–1.5% Albumin, and 5 units/ml Heparin. This buffer was adapted from Strey H., *Bestimmung elastischer Eigenschaften von Zellmembranen und Zytoskelett mittels Flickerspektroskopie*, Ph. D. Thesis 1993, TU München, Germany and Zeman K., *Untersuchung physikalisch und biochemisch induzierter Änderungen der Krümmungselastizität der Erythrozytenmembran mittels Fourierspektroskopie der thermisch angeregten Oberflächenwellen (Flickern)*, Ph. D. Thesis 1989, TU München, Germany. This buffer mimics the physiological conditions in the body. It maintains a pH of 7.4, the additional Heparin prevents the blood from clotting, and the Antibiotics solution keeps the buffer free of bacteria. The RBCs were obtained by drawing a tiny drop of blood (~10 $\mu$l) from the earlobe of volunteers in our lab. The blood was diluted with about 1 ml of the buffer and then stored at 4° C. until usage. This handling preserved them quite well.

Under physiological conditions RBCs have a flat, biconcave, disc-like shape. However, the shape can change depending on the osmolarity of the buffer. If the buffer conditions change to hypotonic (lower concentration, i.e. osmolarity) with respect to the inside the cell starts to swell to relax the osmotic pressure and, if the new osmolarity is chosen right, assumes a spherical shape. Shortly before the actual experiment the cell solution was warmed up to room temperature and diluted by 1:2 with Millipore water which changed the buffer conditions to hypotonic. After a short time (about five minutes), almost all RBCs had a spherical shape and were ready for usage. A spherical object with its rotational symmetry is preferable over other possible geometries for trapping and deformation because its interaction with light and the calculation of the corresponding forces is less complicated.

The first cells used were nerve cells (PC12 rat nerve cells). In contrast to RBCs, these cells have all organelles such as nucleus, mitochondria, and Golgi apparatus normally found in a cell. They also have a three-dimensional cytoskeleton throughout the whole cell body which results in a higher mechanical strength. Nerve cells in vivo usually have two types of extensions which are called axons and dendrites. The nerve cells had not been differentiated yet and did not show these extensions. These cells are cultured in petri dishes and are usually attached to the surface and clustered together. The medium they are growing in is Dulbecco's Modified Eagle's Medium (DMEM) with 10% Horse serum, 5% FBS (fetal bovine serum), and 1% of an Antibiotic-Antimycotic solution (Penicillin/Streptomycin). In order to get them off the surface, they were treated with 0.25% Trypsin-EDTA solution (TRED). Trypsin is a protease which degrades the extracellular matrix and also adhesion receptors. EDTA is a chelating (binding) agent for divalent cations ($Ca^{2+}$, $Mg^{2+}$) required for the proper conformation of these receptors. The procedure is as follows: First the medium is carefully aspirated off the tissue culture dish. Then 1–2 ml of 10 mM phosphate buffered saline (PBS) is added to remove Trypsin inhibitors ($Ca^{2+}$, $Mg^{2+}$, serum). After the PBS is also aspirated off 200–500 $\mu$l TRED is added into the culture dish. With gently tapping the dish the cells are dislodged and clusters are broken up. This treatment with TRED is very rough and care has to be taken that it is inactivated after 30–60 sec by adding fresh medium. The whole cell suspension is then centrifuged for 2–3 minutes at 800 rpm to separate the cells from the solution. The cells are resuspended in fresh medium. The result of this treatment is that the cells will not cluster together or reattach to the surface for 2–4 hours, and assume a nearly spherical shape.

For visualization of the actin cytoskeleton in these cells, 1 μl of Rhodamine-Phalloidin (TRITC) in DMSO was added to 100 μl cell suspension. By repeated trigeration (sucking in and squirting out of the suspension with a pipette) the membrane was transiently permeabilized and the dye was taken up by the cell. Rhodamine-Phalloidin is a fluorescent tag that selectively binds to actin filaments and not to actin monomers. Although the fluorescence of bound rhodamine is three times higher than that of not-bound rhodamine the amount of remaining TRITC in the suspension had to be reduced to decrease the background fluorescence. This was done by centrifugation and resuspension of the cells in fresh buffer. The localization of actin filaments in the cell was then observed with fluorescence microscopy. For the recording, a Zeiss Plan Neofluar (100X, NA 1.30, oil) objective and a SIT-camera (Dage-MTI, SIT68) with an 4X coupler were used. The visualization of the cytoskeleton was important because some people believe that the cells dissolve their cytoskeleton when they are not in contact with each other or with a surface. In this case it would not be possible to measure relevant cell elasticities with a tool such as the Optical Stretcher because the cells are not in contact with anything.

RESULTS

Forces on Deformable Objects

In the trapping scenarios previously described, either non-deformable particles (glass beads, latex beads) were used or the goal was solely to trap, hold, move, and/or rotate these particles. What no one has tried so far is to use these forces that arise with the interaction of light and matter to deform particles in a controlled way. Biological cells are potentially deformable objects. In fact, they must be to perform their tasks in vivo. Their amazing elasticity against external pressure is what we want to elucidate.

The idea was to use a two beam setup as described above to capture and hold a single cell and then to increase the light power to the point where the radiation pressure starts to deform the cell. Intuitively, one would expect that the cell would be squeezed horizontally since the scattering force acts in the direction of the propagation of the light. However, exactly the opposite is the case. The cell is axially stretched out and we will derive the reason for that unexpected effect in this section.

Since we were only interested in the forces on cells (5–20 μm) and we use light with a wavelength of ~800 nm, we will use a ray optics approach. In principle, the calculation is similar to the derivation of the scattering and gradient force on a sphere. We assume that the incoming laser beam can be treated as an ensemble of individual rays with a certain momentum which exert forces on the boundary. The difference to the previous derivation is that for the deformation of the particle the overall force acting on the center of mass is not relevant. Instead we are interested in the force at every single surface element of the particle. For the calculation of the scattering and the gradient force the momentum of the light inside the particle is not needed. It is sufficient to look at the difference between the momentum of the light that enters and that leaves the particle. This difference is picked up by the particle which feels a force acting on its center. However, the fact that the momentum of light changes when it enters or leaves a medium with different optical properties is essential for the calculation of the force on the boundary and must not be neglected. This is exactly the point which explains why the cells are stretched out rather than squeezed.

When a laser beam enters or exits a dielectric liquid it exerts a net outward force and causes the surface to bend. The momentum of light with energy E in a medium with refractive index n is given by, $$p = \frac{E \cdot n}{c} \tag{22}$$

where c is the speed of light. This means that the momentum of light with same energy E is higher inside an optically denser medium than outside. There has been some controversy over the right form for the momentum inside dielectrics. The upper equation is the so-called Minkowski value whereas Abraham proposed, $$p = \frac{E}{c \cdot n} \tag{23}$$

Today, this debate is settled and the Minkowski form is generally accepted[11]. Depending on the incident angle, some light is always reflected backwards and not all energy enters the medium. The net change in momentum for normal incidence, $$\Delta p = p_1(1+R) - p_2(1-R) \tag{24}$$

where $$p_1 = \frac{E \cdot n_1}{c} \text{ and } p_2 = \frac{E \cdot n_2}{c}$$

and R is the reflection coefficient for normal incidence. This difference is balanced by a mechanical force on the medium proportional to Δp, $$F = \frac{\Delta p}{\Delta t} = \frac{\Delta E \cdot n}{\Delta t \cdot c} = \frac{P \cdot n}{c} \tag{25}$$

It is important to note that the effect of the increase in momentum due to the higher refractive index dominates the decrease which is caused by the reflection of some light because cells are almost transparent. This leads to the outward force rather than an inward force.

Using Ashkin's work as foundation, we extend it to this invention. The model cell is assumed to be a spherical, uniform, and lossless dielectric particle with a certain index of refraction $n_2$ suspended in a fluid with refractive index $n_1$. Cells are also rather transparent and hard to see in a through-light microscope which makes the assumption of a non-absorbing particle plausible. The uniformity of the particle is a necessary assumption to keep the calculation simple, but is questionable for a cell with all its small localized structures. The relative index of refraction $n=n_2/n_1>1$ is on the order of 1.05–1.15 for biological materials in aqueous solutions.

In general, the different momenta of the incident, reflected, and refracted rays have certain angles different from 0° relative to each other. Thus, we have to take the vector nature of momentum into account.

$$\Delta \vec{p} = \vec{p}_1 - \vec{p}_2 - \vec{p}_R \tag{26}$$

For the moment, we set the momentum of the incident ray to unity. The other momenta are as follows, $$p_1 = \frac{E \cdot n_1}{c} \equiv 1 \tag{27}$$

$$p_R = \frac{R(\theta) \cdot E \cdot n_1}{c} = R(\theta) \tag{28}$$

$$p_2 = \frac{T(\theta) \cdot E \cdot n_2}{c} = \frac{T(\theta) \cdot n_2}{n_1} = T(\theta) \cdot n \tag{29}$$

The components of the resulting change in momentum in z and y direction are, $$\Delta p_z = \Delta p \cdot \cos\phi = p_1 \cos(0) - p_2 \cos(2\pi - \theta + r) - p_R \cos(\pi - 2\theta)$$

$$= 1 - T(\theta) \cdot n \cdot \cos(\theta - r) + R(\theta) \cdot \cos(2\theta) \tag{30}$$

$$\Delta p_y = \Delta p \cdot \sin\phi = p_1 \sin(0) - p_2 \sin(2\pi - \theta + r) - p_R \sin(\pi - 2\theta)$$

$$= T(\theta) \cdot n \cdot \sin(\theta - r) + R(\theta) \cdot \sin(2\theta) \tag{31}$$

The magnitude of $\Delta p$ is then given by, $$\Delta p = \sqrt{\Delta p_z^2 + \Delta p_y^2} \tag{32}$$

whereas its direction is, $$\phi = \arctan\left(\frac{\Delta p_y}{\Delta p_z}\right) \tag{33}$$

We calculated these quantities numerically with the software Mathematica as functions of the incident angle $\theta$ for n=1.1. Assumed is a laser beam with constant intensity profile independent of the axial distance d.

The absolute magnitude of the momentum transfer increases towards the edge of the sphere and then rapidly drops to zero. Interestingly, the direction of the transferred momentum is always pointing away from the sphere. In fact, it is always normal to the surface. This is easier to imagine with a graphical visualization of the forces on a certain number of points at the surface of the sphere.

The refracted rays do not stop inside (absorption is neglected) but exit the particle on the other side. The sphere acts as a lens and collects them close to the axis. The forces at this boundary are also pointing away from the surface.

The next step is to take the Gaussian profile of the beam into account. This simply means that the power P of a ray with a certain distance d from the axis has to be multiplied by, $$\exp\left(-\frac{2d^2}{w^2}\right) \tag{34}$$

where w is the beam radius. The center of the particle is assumed to be on the optical axis. The forces in the center of the particle are now larger than at the edge and dominate the deformation of the sphere.

The cytoskeleton in a cell, which is connected to the membrane, will act as a spring and build up a restoring tension. The forces on the surface will change corresponding to the deformation until the system reaches equilibrium. The final form of the particle is expected to look like an ellipsoid with the major axis in the direction of the beam axis. In a hand-waving argument, this effect is similar to the case where a dielectric fluid is pulled into the field between two capacitor plates because it is an energetically favorable position. Here the cell is also pulled into the region of higher fields, i.e. the center of the laser beam.

For a quantitative calculation of the deforming forces, we have to change the momentum of the incident rays from unity to its real value. For the highest possible laser intensities we measured the powers transmitted by the SM fiber to be up to 220+/−20 mW. Inserting this value into equation (20) for the momentum of the light we obtained the following force profile on both sides of the sphere when it is trapped in between two laser beams of equal light power. The beam radius and the sphere radius in this case are the same ($\rho/w=1$). The forces in the center are on the order of 0.17 nN and decrease towards the edge of the sphere. The jump in the profile occurs because the second laser beam coming from the other side is collimated towards the middle.

For the MM fiber we measured transmitted powers of 500+/−25 mW for the highest laser intensity. The corresponding force profile has the same shape with a central force of 44.3 pN (at $d/\rho=0$).

When a force F acts normal to the surface A of a body it is stretched out by $\Delta L$. The relation between the stress $\sigma=F/A$ and the relative deformation $\epsilon=\Delta L/L$ is linear over a certain range and described by, $$\sigma = E\epsilon \tag{35}$$

The relative deformation $\epsilon$ is a number and the stress $\sigma$ has the dimension of force per area. Thus the proportionality constant E, called Young modulus, also has the dimension force per area. The situation when a constant force acts on the side of a cube is much simpler than the situation on the surface of a sphere. The forces on the surface of a cell turn out to be not constant and act on a curved surface.

To get an estimate for the elasticity of the cells we calculated the force per area, i.e. stress. Since the forces are all normal to the surface, the calculation is simply accomplished by using the intensity I rather than the power P of the incident rays in the above formulas, $$\frac{F}{\Delta A} = \frac{\Delta p}{\Delta A \cdot \Delta t} = \frac{n \cdot \Delta E}{c \cdot \Delta A \cdot \Delta t} = \frac{n \cdot I}{c} \tag{36}$$

The intensity is related to the power by, $$I_0 = \frac{2}{\pi \cdot w^2} P_\infty \tag{37}$$

Thus, the shape of the stress profile is the same as the force profile. The light intensities of a beam with radius 5.0 $\mu$m at the surface of a cell with the same radius are about $5.0\times10^5$ W/cm$^2$ (SM)/$1.3\times10^6$ W/cm$^2$ (MM) and yield force densities in the center of about 4.5 Pa and 11 Pa respectively. The total stress on one side of the cell that causes the deformation is the integral of the stress profile. We did this calculation numerically and obtained a total stress of 16 Pa for the 200 mW transmitted by the SM fiber, and 40 Pa for 500 mW when using the MM fiber. We will use these quantities for an estimate of the Young modulus of cells.

So far, we have always assumed that the relative index of refraction is n=1.1. A slight increase in this number to n=1.2, which is on the upper limit of the range of values for biological materials, has only a small effect on the qualitative shape of the force profile. The lens effect is a little bit stronger than for n=1.1 and leads to an increased collimation of the rays on the backside of the cell. However, the absolute quantities turn out to change more drastically. The central force for the two beam trapping situation is 35 (88) pN for 200 mW (500 mW) and thus about twice as big as for n=1.1. The total stress on the sphere for n=1.2 has also nearly doubled and is 26 (74) Pa for powers of 200 mW and 500 mW respectively. Thus it will be important to determine the real index of refraction as good as possible.

EXPERIMENTAL RESULTS

Trapping of Cells

In general, all trapping features of the two beam trap as predicted and reported in the literature can be observed with our setup. The first criterion, that the refractive index n of the trapped particle has to be higher than that of the surrounding, is fulfilled intrinsically: the n of water under normal conditions is 1.33 whereas n of cells has been reported to be in the range from 1.4–1.6. Secondly, the beam radius has to be larger than the radius of the trapped object. The largest radius of a RBC that we measured was 4.0 $\mu$m. The beam radius w at the SM fiber tip is 2.5 $\mu$m ($=w_0$) and increases due to divergence with increasing distance z according to $$w(z) = w_0 \cdot \sqrt{1 + \left(\frac{\lambda \cdot z}{w_0^2 \cdot \pi}\right)^2} \tag{38}$$

where $\lambda$=790 nm is the wavelength of the light. $Z_{min}$ is the distance for which the radius of the beam is exactly the radius of the cell. For a distance $z>z_{min}$=31 $\mu$m the beam radius is larger than the RBC radius. Typical fiber distances in our experiments are in the range from 100–300 $\mu$m>2 $z_{min}$ so that the second stability criterion is also always fulfilled. PC12 cells have diameters up to 15 $\mu$m and the required minimal fiber distance for stable trapping is 140 $\mu$m. For these cells we had to make sure that the fiber distances are sufficient for stable trapping.

The MM fiber has a mode field diameter of 50 $\mu$m which is much larger than the diameters of all cells under investigation. Thus, cells can be trapped with MM fibers regardless of the fiber distances. It might be surprising that we achieved stable trapping at all with the MM fiber and we will discuss that below.

In all cases, when care was taken that the intensity of the two beams was identical and the fiber distances were sufficient, we achieved stable trapping in the middle of the two fiber ends. When the ends were moved too close together, so that the diameter of the diverging beams was smaller than the diameter of the trapped cell, the trapping became unstable and the cells moved slowly towards one of the fibers as expected.

Stretching of Cells

Above, we calculated the force profile on the surface of a spherical object when it is trapped with two counter-propagating laser beams. The deformation of the cells in our experiments was exactly as expected from this calculation. It is also possible to detect differences in the elasticity of two different kinds of cells. We will show examples for the deformation of a RBC and a PC12 cell and give a simple estimate for their stiffness. More thorough experiments have to follow to investigate, for example, the frequency dependence of the measured stiffness. At extremely high frequencies hydrodynamic effects might play a role. The deformations could be so fast that the water cannot follow quick enough and causes apparently higher stiffnesses. At very low frequencies on the other hand, the cell might have time enough to restructure the cytoskeleton. Rheology experiments on polymer solutions reveal so-called plateau-moduli over a broad intermediate region, which are constant and independent of the frequency. We applied the forces in the range of 0.1–1 Hz where the elasticity of the cells should be independent of the frequency.

The general proceeding is as follows: after a single cell is trapped at light powers of about 2–10 mW, we increase the power manually to its maximum values of 200 mW (SM)/500 mW (MM) by increasing the driver power for the AOM. The deformation of the cell is recorded on tape and is analyzed later by counting the number of calibrated pixels in NIH Image. For the calculation of the total stresses on the cells we assumed a relative index of refraction of n=1.1 and a relative sphere radius of $\rho/w$=1.

Stretching of RBCs

The RBC had been osmotically swollen to achieve a spherical shape and to it was applied total stress of 16+/−1 Pa. The stretching of the cell can easily be seen. The elongation along the major axis in this case was from 6.08+/−0.02 $\mu$m to 6.54+/−0.02 $\mu$m. This is a relative deformation $\epsilon$=7.6+/−0.6%. The average deformation was $\epsilon$=7.5+/−0.3%. We used equation (35) to obtain an estimate for the Young modulus E=210+/−10 Pa. This value does not reflect the strength of the two-dimensional cytoskeleton of RBCs which should be much weaker, but rather the resistance by osmotic pressure.

In this fashion we were able to stretch all RBCs that we had trapped. This is the proof that our setup is really capable of deforming cells in a controlled way. The deformations of several hundred nanometers can easily be detected with this technique. In some cases, where we trapped apparently weaker cells, the stress was sufficient to tear the cell apart.

Stretching of PC12 Cells

PC12 cells, as an arbitrary normal cell, have an extensive three-dimensional cytoskeleton, whereas RBCs only have a layer of cytoskeleton right under their membrane. Thus, it was expected that it would be much harder to deform PC12 cells. We used MM fibers to be able to apply a higher stress on the cell. The general proceeding was the same as before. First, we trapped a single cell in between the two laser beams at powers of 2–10 mW and then increased the light power to about 500+/−25 mW. The deformation was not as obvious as for RBCs. The comparing of the horizontal width of the cell in the two pictures by image processing, however, revealed a clear elongation from 11.14+/−0.02 $\mu$m to 11.69+/−0.02 $\mu$m which corresponds to a relative deformation of $\epsilon$=4.9+/−0.4%. To assure that this is the real deformation we ruled out the following artifacts: since the cell is not perfectly spherical the increase of the stress could cause the cell to rotate which would lead to an increase of the measured diameter in the horizontal direction. We only evaluated pictures where this was not the case. Another possibility could be that the trapped cell is slightly away from the beam axis. When the intensity is increased, and the cell is pulled back towards the axis, the main cross-section moves out of the focal plane. This can be ruled out because it would lead to an identical absolute increase in the horizontal and the vertical direction which is not the case. The average deformation of PC12 cells was $\epsilon$=4.2+/−0.2% at a total stress on the cell of $\sigma$=40+/−1 Pa. The Young modulus is calculated to be E=950+/−50 Pa (equation 35). This is only a first estimate and probably a lower bound for the real elasticity for comparison: With an AFM the Young modulus of human platelets has been measured to be between 1–50 kPa in the frequency range of 1–50-Hz since first experimental measurements of the forces indicate that the calculated stress might be too small. PC12 cells are thus at least 4–5 times stiffer than osmotically swollen RBCs.

Calibration of the Forces

As long as we are only interested in a phenomenological comparison between two optically similar cells, it is sufficient to compare the observed deformations for the same light powers and fiber distances. A different cytoskeleton should result in a different elastic response as demonstrated for RBCs and PC12 cells. This is exactly the way we will be able to distinguish between normal and malignant cells. However, for a more quantitative description we need a way to measure, or to calibrate and calculate the actual forces. We especially need to determine precise numbers for the elasticity constants for the investigation of the physical properties of the cytoskeleton as a polymeric compound material. By comparing the measured forces and the previously calculated forces, we also have the opportunity to verify that our simple model of the forces on the cell is valid. The measuring of the forces is not easy and we have to take a very simple approach: When a cell is trapped stably we switch off one of the laser beams. The situation is now the one described for one beam. There is a net force in the direction of the light propagation acting on the particle which pushes the particle through the fluid. The particle reaches a constant velocity when the Stoke's friction, $$F_{Stokes}=6\pi\cdot\eta\cdot r\cdot v=F_{net} \tag{39}$$

where $\eta$ is the viscosity (water: 1.0 Pa s at 25° C.), r is the particle radius, and v is the velocity, balances the accelerating force. By measuring the velocity, we can get an estimate of the total net force. The velocity in our experiment was 11.2+/−2.7 $\mu$m/s at about 100 mW for RBCs with a radius of 5 $\mu$m. This velocity corresponds to a force of about 1.1+/−0.2 nN. The total net force in our model is calculated to be F=27 pN for n=1.1 and F=85 pN for n=1.2 at 100 mW. This is a considerable difference which can be explained in several ways:

One possibility is that the index of refraction of the cell is higher than was assumed. This would lead to an underestimation of the calculated force since the force is highly sensitive to the index of refraction, as derived herein. Another possible explanation is that the model might be too simple. It predicts the qualitative nature of the deforming forces quite well but might be off quantitatively. Since the membrane and its constituent phospholipids have a higher refractive index than the cytoplasm, it might be more realistic to assume a spherical shell with a certain index of refraction filled with another dielectric with a refractive index lower than the shell but higher than the surrounding medium. A last fact that is not included in the model is that some light is absorbed when it passes through the cell. Including this would also increase the calculated net force in the forward direction because more momentum of the incident light is picked up by the cell.

Some of the previously mentioned problems can be addressed in additional experiments. Instead of shooting cells with one beam to measure the net force we can use glass beads. This has the advantage that we know the refractive index exactly and we can test the influence of other variables such as the intensity.

The same experiment can be done with spherical vesicles. A bilayer of phospholipids in an aqueous solution will form a closed surface because it is energetically favorable. These objects are called vesicles. They are an ideal test object because the main component of the cell membrane are phospholipids. This is the same for RBCs and was one of the reasons to choose them as initial test objects. The advantage of vesicles over RBCs is that we can vary the refractive index of the interior by forming the vesicles in solutions of different sugar solutions. After the vesicles have formed, the exterior of the vesicle can also be varied by changing the type of sugar dissolved in it and the sugar concentration. If the forces measured for vesicles differ qualitatively from those for glass beads, which are at presence exactly described with our model, we will have to take the shell-like nature of cells into account.

Another possibility with vesicles is that the interior osmotic pressure of the system can be determined by changing the osmolarity of the surrounding solution. Water molecules, in contrast to charged and larger molecules, can diffuse relatively easy across the membrane. If the ionic strength of the solution outside is changed, an osmotic pressure builds up which can be precisely calculated. This is also true for the osmotic swelling of RBCs. However, when the vesicle is trapped in between two laser beams the deforming forces on the surface are solely balanced by the osmotic pressure which is not supported by a cytoskeleton as in RBCs. The membrane itself is so soft that it can be ignored. This is another possibility to directly measure the deforming stress.

Viability of Cells

An important issue is the viability of cells since this was one of the points of critique upon existing methods. It is not obvious that it is possible to use high intensity laser beams for the deformation of such fragile objects as cells without causing any harm to them. It has been shown that 250 mW of 1064 nm light will damage most cells. However, this is only true for the situation in an optical tweezer because the laser beam has to be focused down to very small spot sizes. The intensity in this case is on the order of $10^8$ W/cm$^2$, which is three orders of magnitude larger than that encountered in the Optical Stretcher. Another big difference is the careful choice of the least damaging wavelength. The absorption coefficient of water is reduced by a factor of ten when 780 nm light is used instead of the 1064 nm of a Nd-YAG laser. This is important because the local heating of water is a key limiting factor for the survival of cells which, in most cases, can only survive in the temperature range from 35–42° C. However, other damaging effects, such as the direct absorption of light by chromophores or photochemistry, as discussed above, might come into play.

We addressed the viability of the cells under investigation (PC12) in several ways. First of all, the appearance of the cells is significantly different when they are not alive. Living cells under a phase-contrast microscope show a characteristic bright rim around the edge; they actually appear to be glowing. Dead cells do not show this feature. They usually have no sharp contour and appear diffuse.

After we had trapped and stretched a cell for several minutes, we always followed it sinking down to the coverslide where we compared its appearance to other cells that had not been irradiated. In all cases the cells looked alike. The slight difference in the appearance is due to the fact that the trapped cell had less time to reattach to the surface. However, the characteristic bright rim indicates that all cells in this picture are alive.

A more careful approach is the use of a vital stain such as Trypan Blue. As long as a cell is alive it is able to prevent the dye from entering the cytosol. However, if the cell is dead or does not maintain its normal function, the dye will penetrate the cell membrane and the whole cell appears blue. We added 5% (volume) Trypan Blue to the cell solution after we had trapped and deformed the cell, and we did not observe any staining.

A third, analytical, check was done on cells in cell culture dishes. Four culture dishes were each loaded with $(1.6+/-0.2)\times10^5$ cells. Two of those were irradiated with 500 mW of 790 nm laser light for 5 minutes by pointing one of the MM fibers directly at the cells and the other two were kept as control. The cells were allowed to grow under ideal conditions in an incubator at 37° C. and in an 5% $CO_2$ atmosphere. After four days the irradiated cells did not show any sign of difference to the control cells which had not been irradiated. The total number of cells per dish increased to $(4.1+/-0.2)\times10^5$ (control) and $(4.2+/-0.3)\times10^5$ (irradiated) over the period of four days. This was the strongest of the three tests because it monitored if the cells are still capable of dividing normally. All three tests prove that the cells survive the conditions in an Optical Stretcher without any detectable damage.

Another important question for the applicability of the Optical Stretcher to measure normal cell elasticities is, whether cells maintain a cytoskeleton at all when they are trypsinized and in suspension. For a check of this condition we stained the actin cytoskeleton of living, freshly trypsinized PC12 cell. TRITC stains exclusively actin filaments and not single monomers, and its fluorescence increases by a factor of 3 when bound to a filament. This assures that we see filamentous actin and not actin monomers. The cells do have an extensive actin network throughout the whole cell volume. Also the actin cortex can be seen at the rim of the cell. The only feature of the cytoskeleton which is not present are stress fibers. However, those should play only a minor role for the elasticity of cells.

To summarize we can say that the Optical Stretcher really measures the elasticity of living, normal cells and preserves their integrity.

SM versus MM

All reported fiber optical realizations of light traps were built with SM fibers. The justification was that it is very important to have a Gaussian beam profile for an efficient axial confinement by the gradient force. We found it also possible to use multimode ("MM") fibers. The profile is not Gaussian anymore but the highest intensity is still in the center and particles are attracted by this high field. The second stability criterion, that the beam diameter is larger than that of the cells, is fulfilled more easily since the mode field diameter of MM fibers (50 $\mu$m–500 $\mu$m) is much larger than for SM fibers (5 $\mu$m). The big advantage is that MM fibers are capable of transmitting more light than SM fibers, 500 mW instead of 200 mW, and thus allow for higher forces. In fact, we had to use a MM fiber for the deformation of PC12 cells. With the MM fiber we can get to the highest possible intensities for deformation. The intensity is only limited by the absorption of water. At very high intensities the water was heated up so much that the system became unstable and a convection roll formed which flushed the trapped cells out of the trap. At this point the cells were probably dead anyway. At even higher intensities water evaporated and bubbles appeared. Although it is possible to use MM fibers, it is much more convenient to use SM fibers unless really high intensities are needed.

All reported fiber optical realizations of light traps were built with SM fibers. The justification was that it is very important to have a Gaussian beam profile for an efficient axial confinement by the gradient force. We found it also possible to use multimode ("MM") fibers. The profile is not Gaussian anymore but the highest intensity is still in the center and particles are attracted by this high field. The second stability criterion, that the beam diameter is larger than that of the cells, is fulfilled more easily since the mode field diameter of MM fibers (50 mm–500 mm) is much larger than for SM fibers (5 mm). The big advantage is that MM fibers are capable of transmitting more light than SM fibers, 500 mW instead of 200 mW, and thus allow for higher forces. In fact, we had to use a MM fiber for the deformation of PC12 cells. With the MM fiber we can get to the highest possible intensities for deformation. The intensity is only limited by the absorption of water. At very high intensities the water was heated up so much that the system became unstable and a convection roll formed which flushed the trapped cells out of the trap. At this point the cells were probably dead anyway. At even higher intensities water evaporated and bubbles appeared. Although it is possible to use MM fibers, it is much more convenient to use SM fibers unless really high intensities are needed.

It can be seen that this invention provides a nondestructive, optical tool for the quantitative deformation of cells. The radiation pressure of two counter-propagating laser beams of a cw Ti-Sapphire laser at 790 nm is sufficient to deform a cell which does not show any sign of detectable damage and maintains its normal cytoskeleton. Surprisingly, the cell is not squeezed but rather stretched out along the optical axis. This effect has never been observed before and can be used to distinguish between different cells. We also developed a simple model of the forces on the cell which predicts the force profile on its surface and qualitatively explains the observed deformations rather well.

When cells were stably trapped between the two beams, an increase of the light power lead to a clear stretching of the cells. In this way, we were able to deform osmotically swollen RBCs, as an initial test object, at a light power of 200 mW from a spherical shape to an ellipsoid-like form. The major axis of the cell was elongated on average by 7.5+/−0.3%. The Young modulus for a stress of $\sigma$=16+/−1 Pa is calculated to be E=210+/−10 Pa. This is not the elasticity of the cytoskeleton alone, but also due to the osmotic pressure inside the cell.

We also showed that cells with an extensive three-dimensional cytoskeleton, which are much stiffer than RBCs, can be deformed in the same way. The deformation of several hundred nanometers can clearly be measured with our procedure. As initial arbitrary cells we used PC12 cells, rat nerve cells which have not yet been differentiated. We was able to stretch them out along the optical axis on average by 4.2+/−0.2% with light powers of 500 mW. The calculated Young modulus in this case was E=950+/−50 Pa for a stress of $\sigma$=40+/−1 Pa. Thus, PC12 cells are about 4–5 times stronger than osmotically swollen RBCs. These findings show that this invention can distinguish between different cells by detecting phenomenological differences in their elasticities.

Several tests assured that the stretching and the irradiation of living cells with up to 500 mW of 790 nm laser light, as encountered in these experiments, do not cause any loss of viability. This is due to the careful choice of the wavelength to minimize optical damage and to the specific situation in the two-beam trap where the laser beams are not focused. Thus, we can use laser powers which would be lethal in an optical tweezer because the strong focusing leads to extreme intensities. We also addressed the question whether trypsinized cells in solution maintain a normal cytoskeleton and exhibit the same mechanical strength as cells attached to a surface. In contrast to a general misbelief, we were able to show with extensive fluorescence microscopy that they indeed have a normal cytoskeleton even when they are spherical and suspended in solution. The only difference is that the cell disassembles stress fibers which should only play a minor role for the overall elasticity of the cytoskeleton. Besides that, this invention measures relevant elasticities.

We also developed a simple model for the interaction of the two laser beams with cells which is capable of qualitatively describing the observed deformations quite well. The calibration of the forces seems to be rather difficult because they change from object to object. The exact forces depend on the local structures inside the cell and on its non-uniform index of refraction. The total possible stress on a cell, as calculated with the present model, is in the range of 10–100 Pa for assumed relative indices of refraction between 1.1–1.2 and light powers up to 500 mW. The relative index of refraction n has a rather strong influence on the magnitude of the total stress. A change from n=1.1 to n=1.2 increases the stress by a factor of two. First experiments to measure the actual deforming forces indicate that the real stresses might by even higher than the calculated numbers by a factor of 20. Thus, the calculated cell elasticities above are first estimates and should be seen as lower bounds for the real elasticity.

A flow chamber which will have several advantages over the present open setup (See FIG. 2). This chamber may be constructed out of silicon with micro-manufacturing techniques. The necessary alignment will be achieved by etching two V-grooves along the 111-planes of the crystal. One of the grooves will lead the two fibers and will guarantee sufficient alignment. The second, perpendicular, groove will serve as flow channel for the cell solution. A center hole will provide optical access for the observation of the trapping and deformation. Another idea is to use synchrotron radiation to "drill" the two perpendicular channels with high accuracy into PMMA. Since PMMA is transparent the observation hole is obsolete, which in the other setup might cause problems, such as turbulence or leakage.

Either way, using a closed flow chamber will allow us to deliver cells into the trapping region in a controlled way. We will be able to supply fresh medium or change the medium while the cell is trapped. It will be necessary for the preservation of sensible cells to maintain an ambient temperature of 37° C. which can be easily achieved with a heated flow chamber. Most important is the possibility to analyze larger sample sizes, in contrast to the current setup and to all prevalent techniques. Even in the same cell line, the size and the shape of cells differs and thus it is to expect that also the elasticity has a large variance. For this reason, it is essential to measure the elasticity of many cells to get statistically relevant results. In the flow chamber, the cells will be flowing through the gap between the two fiber tips. When the laser light is switched on, a cell will eventually be trapped, the cell flow will be stopped, and the cell elasticity can be measured. This procedure can be repeated as often as desired. The control of the cell flow, the observation of the trapping and squeezing, and the evaluation of the data can in principle be controlled by a computer.

It is contemplated that in the future, laser diodes with sufficient power, mode quality, and stability and with directly attached optical fibers will become available that will make the need for large and expensive laser systems and additional optics obsolete. The Optical Stretcher can then be realized in a very small version and has the potential to be used as a clinical tool.

World-wide, the rate of cancer as a cause of death is rapidly increasing despite tremendous progress in cancer therapy within the last 30 years. Cancer is often diagnosed very late, rendering treatment ineffective. Biopsy of tissue samples examined by light microscopy is still the most common technique to detect cancer. If cells in thin sections of tissue show a highly irregular shape, this is a clear indicator of malignant cells. Biopsy is invasive as well as cost- and labor-intensive. Thus it is only applied in case of clear signs of cancer, such as a noticeable mass or lump. However, more advanced cancer detection techniques have their own limitations. Existing cytological analyses—examination under a microscope of cells from a Pap smear, for instance—are often insufficient for identifying a small number of abnormal cells by size and shape alone. Flow cytometry has rapidly expanded from basic research to clinical laboratories. Among the clinical uses of flow cytometry, cancer represents one of the most relevant. However, problems due to sample quality, staining, and instrumental artifacts limit accurate interpretation of data. Genetic testing, molecular DNA probes, and enzyme markers are limited, because each cancer has its own molecular signature and so will require its own test.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as illustrative embodiments. Equivalent elements or materials may be substituted for those illustrated and described herein, and certain features of the invention may be utilized independently of the use of other features, all as would be apparent to one skilled in the art after having the benefit of this description of the invention.

What is claimed is:

1. An apparatus, comprising:

a stage capable of supporting micron-sized dielectric particles;

two or more sources of laser light directed toward an area of the stage where the particles are located;

a first detector which determines whether a particle is trapped between the laser sources;

a second detector which determines and measures deformation of a particle upon increasing intensity of the laser light;

wherein the laser sources are adjustable so that the power of the laser light is to thereby trap a particle and then stretch the particle toward the two or more laser sources.

2. The apparatus of claim 1 wherein the first detector measures variance in current.

3. The apparatus of claim 1 where the first and second detectors are a single unit.

4. The apparatus of claim 1 wherein the particles are small tissue samples or individual biological cells.

5. The apparatus of claim 1 wherein the laser sources are directed by single mode optical fibers.

6. The apparatus of claim 1 wherein the laser sources are directed by multimode optical fibers.

7. The apparatus of claim 1 wherein the laser sources operate at a wavelength of about 740 nm to about 840 nm.

8. An apparatus, comprising:

a stage capable of supporting micron-sized dielectric particles;

two or more sources of laser light directed toward an area of the stage where the particles are located;

a first detector which determines whether a particle is trapped between the laser sources;

a second detector which determines and/or measures formation of a particle upon increasing intensity of the laser light;

wherein laser sources are adjustable so that the power of the laser light is variable to thereby trap and then stretch the particle toward the two or more laser, wherein the detector determines the deformation by measuring the variance in current through an aqueous medium between two assymetric pin holes between which the particle is trapped.

9. The apparatus of claim 1 wherein the particles are fed into the laser trap by a flow chamber geometry.

10. The apparatus of claim 1 where the particles are biological tissue samples or cells.

11. The apparatus of claim 1 wherein the laser sources comprise optical fibers that are connected to a single Ti sapphire laser which transmits laser light through the optical fibers.

12. A process for the detection of individual cancer cells by measuring their deformability using the apparatus of claim 1.

13. A process for the controlled deformation of micron-sized dielectric particles, comprising:

exposing a particle to two or more counterpropagating laser beams at intensities and under conditions effective to deform the particle by stretching the particle toward the two or more laser sources to thereby deform the part; and optionally measuring the deformation of the particle.

14. The processes of claims 13 using an apparatus as claimed in claim 1.

15. The process of claim 13 wherein the beams have a wavelength of from about 740 nm to about 840 nm.

16. The process of claim 13 wherein the particles are biological tissue samples or cells.

17. The process of claim 13 wherein the measuring is performed by visual inspection.

18. The process of claim 13 wherein the measuring is performed electronically.

19. A process for the controlled deformation of micron-sized dielectric particles, comprising:

exposing a particle to two or more counterpropagating laser beams at an intensity and under conditions effective to deform the particle; and optionally measuring the deformation of the particle by stretching the particle toward the two or more laser sources to thereby deform the particle, wherein the measuring occurs by measuring the variance in current through an aqueous medium between two asymmetric pin holes between which the particle is trapped.

20. The process of claim 13 wherein the process is conducted in the absence of optical lenses that guide the beams to the particles.

* * * * *

UNITED STATES PATENT AND TRADEMARK OFFICE

CERTIFICATE OF CORRECTION

PATENT NO. : 6,067,859
DATED : May 30, 2000
INVENTOR(S) : Josef A. Kas and Jochen R. Guck It is certified that error appears in the above-identified patent and that said Letters Patent is hereby corrected as shown below:

Column 1,
Line 2, just after the title, insert the following paragraph -- This application claims priority to provisional application serial number 60/076,727, filed March 4, 1998. --.

Signed and Sealed this

Fifth Day of November, 2002

*Attest:*

*Attesting Officer*

JAMES E. ROGAN
*Director of the United States Patent and Trademark Office*